United States Patent [19]

Kubota et al.

[11] 4,360,765

[45] Nov. 23, 1982

[54] CONTROL CIRCUIT FOR A GLOW PLUG ASSEMBLY SERVING AS AN ENGINE PREHEATING MEANS

[75] Inventors: Yutaka Kubota, Kawagoe; Hitoshi Sugimoto, Higashimatsuyama, both of Japan

[73] Assignee: Diesel Kiki Kabushiki Kaisha, Tokyo, Japan

[21] Appl. No.: 237,994

[22] Filed: Feb. 25, 1981

[30] Foreign Application Priority Data

Mar. 7, 1980 [JP] Japan ..... 55-28894

[51] Int. Cl.[3] ..... H05B 37/02

[52] U.S. Cl. ..... 315/209 M; 315/80; 315/184

[58] Field of Search ..... 313/316; 315/209 M, 315/184, 80

*Primary Examiner*—Harold A. Dixon

*Attorney, Agent, or Firm*—McAulay, Fields, Fisher, Goldstein & Nissen

[57] ABSTRACT

A control circuit for a glow plug assembly serving as an engine preheating means is designed so as to effect a temperature control in harmony with the specified position established by selective operation of a key switch having three switching positions, i.e., OFF, ON and START positions. The control circuit is capable of effecting three modes of operation: One is that, when the key switch is switched from OFF position to ON position, the glow plug assembly is energized to rapidly effect a preheating of the engine, and is deenergized when the temperature thereof reaches a predetermined value; Second is that, when the key switch is switched from ON position to START position, the voltage smaller than that at the time of the preheating is applied to the glow plug assembly to effect a first heat retention having substantially the same temperature as that of the aforesaid predetermined value; Third is that, when the key switch is switched from START position to ON position, power is intermittently fed to the glow plug assembly to effect a second heat retention having the temperature lower than or closer to the aforesaid predetermined value.

3 Claims, 2 Drawing Figures

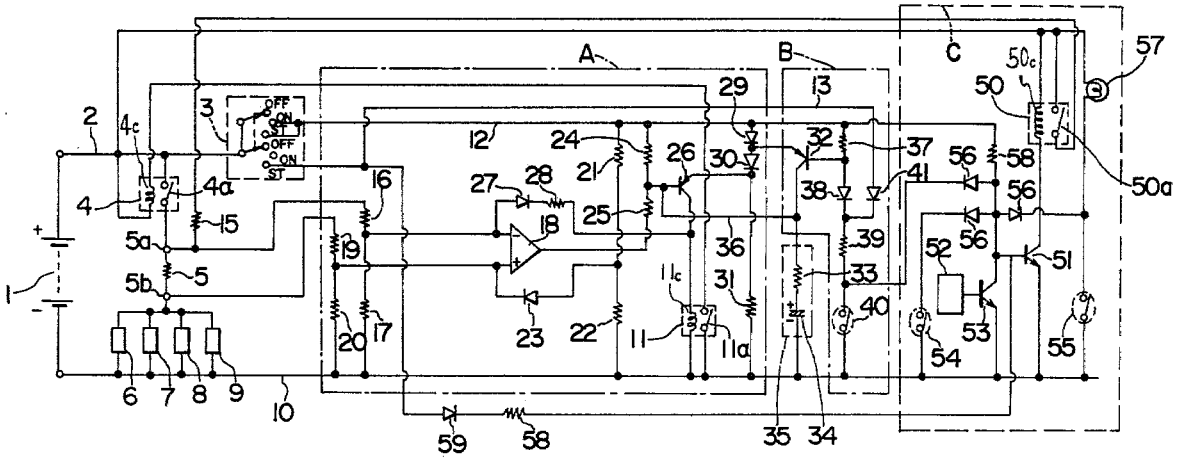
FIG. 1
FIG. 2
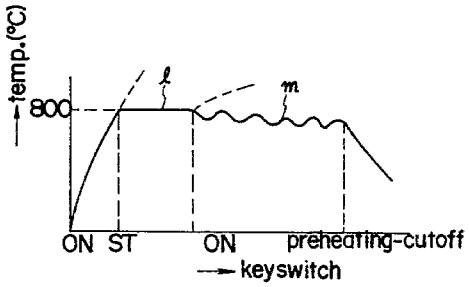

CONTROL CIRCUIT FOR A GLOW PLUG ASSEMBLY SERVING AS AN ENGINE PREHEATING MEANS

BACKGROUND OF THE INVENTION

The present invention relates to a control circuit for a glow plug assembly serving as an engine preheating means, and more particularly to a control circuit designed so as to effect a temperature control in harmony with the specified position established by selective operation of a key switch.

Generally, before starting an engine with a starter motor, it is necessary to set a temperature of the glow plug assembly, serving as an engine preheating temperature, to the level suitable for immediate starting thereof, for example, substantially 800° C. In the prior art, power is applied to the glow plug assembly in accordance with the operation of a key switch to heat the glow plug assembly. However, with this method, the following drawback is pointed out; there is a possibility that the temperature of the glow plug assembly excessively increases or decreases. As a result, the durability of the glow plug assembly is reduced or the engine cannot be started for a short interval.

Reference is made to another aspect of the preheating method. For instance, in the event that the temperature of the engine is relatively high, the engine can be sufficiently started by preheating the glow plug assembly simultaneously with the selection of the key switch to the START position. However, in prior arts, the glow plug assembly is designed so as to be preheated solely in accordance with the operation of the key switch to the ON position. Therefore, the prior art device is not favorable in terms of power consumption.

SUMMARY OF THE INVENTION

A primary object of the present invention is to provide a control circuit for a glow plug assembly serving as an engine preheating means capable of setting a temperature of glow plug assembly to an adequate value, when a key switch is placed in condition for ON position or START position, to start the engine in a stabilized manner.

A second object of the invention is to provide a control circuit for a glow plug assembly serving as an engine preheating means which makes it possible to minimize an undesirable heating of the glow plug assembly to increase the durability.

A third object of the invention is to provide a control circuit for a glow plug assembly serving as an engine preheating means which makes it possible to minimize power consumption by interrupting a power to the glow plug if the glow plugs need not be heated, such as if the engine is already in a heated condition.

BRIEF DESCRIPTION OF THE DRAWINGS

Further objects, features and advantages of the present invention will become apparent from the following detailed description in connection with the accompanying drawings, wherein:

FIG. 1 is a circuit diagram showing a preferred embodiment of a control circuit for a glow plug assembly in accordance with the present invention; and FIG. 2 is a characteristic curve showing the operation of the control circuit for glow plug assembly shown in FIG. 1.

DETAILED DESCRIPTION OF THE PREFERRED EMBODIMENTS

Referring now to FIG. 1, a conductor 2, which is connected to the positive (+) terminal of a battery 1, is connected to one end of a key switch 3, to one end of a normally open contact 4*a* and a relay winding 4*c* constituting a relay switch 4. The normally open contact 4*a* has the other end connected through a resistor 5 to the terminal of glow plugs assembly consisting of a plurality of glow plugs 6, 7, 8 and 9 respectively provided on combustion chambers of the engine, the glow plugs 6 to 9 each having the other terminal connected to an earth wire 10, which is connected to the negative (−) terminal of the battery 1. The relay winding 4*c* has the other end connected through a relay switch 11 consisting of a relay winding 11*c* and a normally open contact 11*a* to the earth wire 10. The key switch 3 has three switching positions, i.e., OFF, ON and ST positions wherein a movable contact is changeable therebetween. A common conductor 12 is connected to an ON contact and a ST contact with a conductor 13 connected to another ST contact.

Reference character A denotes a temperature detecting circuit wherein resistors 16 and 17 are interposed in series between one end 5*a* of the resistor 5 and the earth wire 10, with a junction between the resistors 16 and 17 connected to an inverting input terminal of a comparator 18. Resistors 19 and 20 are interposed in series between the other end 5*b* of the resistor 5 and the earth wire 10, with a junction between the resistors 19 and 20 connected to a non-inverting input terminal of the comparator 18. Resistors 21 and 22 are interposed in series between the conductor 12 and the earth wire 10, with a junction between the resistors 21 and 22 connected through a diode 23 to the non-inverting input terminal of the comparator 18.

Further, resistors 24 and 25 are interposed in series between the conductor 12 and an output terminal of the comparator 18, with a junction between the resistors 24 and 25 connected to a base electrode of a transistor 26. The transistor 26 has a collector electrode connected to the earth wire 10 through a relay winding 11*c* of the relay switch 11. The comparator 18 has an inverting input terminal connected to a junction between the collector electrode of the transistor 26 and the relay winding 11*c* through a diode 27 and a resistor 28 connected in series. Further, diodes 29 and 30 and a resistor 31 are interposed in series between the conductor 12 and the earth wire 10, with a junction between the diode 30 and the resistor 31 connected to an emitter electrode of the transistor 26.

A junction between the diodes 29 and 30 is connected to an emitter electrode of a transistor 32, a collector electrode which is connected to the earth wire 10 through a trigger circuit 35 comprising a resistor 33 and a capacitor 34 connected in series. Then, the base electrode of the transistor 26, and a junction between the collector electrode of the transistor 32 and the trigger circuit 35 are placed in short circuit by a conductor 36.

Further, a resistor 37, a diode 38, a resistor 39 and a water temperature switch 40 are interposed in series between the conductor 12 and the earth wire 10, with a junction between the resistor 37 and the diode 38 connected to the base terminal of the transistor 32. The water temperature switch 40 is turned on when a temperature of cooling water for the engine is above a predetermined level. A conductor, which is connected to the ST contact of the key switch 3, is connected to a junction between the diode 38 and the resistor 39 through the diode 41. Reference character B designates a power interrupting circuit.

One end of a resistor 15 is connected to the junction 5*a*. The resistor 15 is connected to a power source through a contact 50*a* of a relay 50, the relay 50 being connected to a transistor 51, the transistor 51 having its base connected to a collector of a transistor 53, which is turned on and off by an output from an oscillator 52. Between the collector and emitter electrodes of the transistor 53 are connected the water temperature switch 40, a gear switch 54 and a regulator switch 55 through respective diodes 56. Reference numeral 57 designates a charge lamp. The transistor 51 is connected to the ST contact of the key switch 3 through a resistor 58 and a diode 59. Reference character C designates a heat retaining circuit.

The operation of the contact circuit of glow plug assembly as constructed above will be discussed with reference to FIG. 2 which shows the temperature characteristics. In the state where the engine is at a low temperature (when the water temperature switch 40 is placed in OFF condition), when the key switch 3 is set to the ON position, the capacitor 34 of the trigger circuit 35 is charged through the resistor 24. As a result, the transistor 26 is turned on so that the relay winding 11*c* of the relay switch 11 is energized to close the contact 11*a*. Accordingly, the relay winding 4*c* of the relay switch 4 is also energized to close the contact 4*a* so that battery voltage is applied to the glow plug assembly through the resistor 5 having a small coefficient of resistance per unit of temperature.

A heating element constituting each glow plugs 6 to 9 comprises a resistance element having a large positive coefficient of resistance per unit of temperature, such as for example Ni where its resistance value is approximately 0.1Ω at a room temperature. Since in addition to the small resistance value of the heating element, the resistor 5 has also a small resistance value, approximately 0.007Ω, the glow plugs 6 to 9 are rapidly heated. Accordingly, the resistance value of the heating element also increase accordingly as the glow plugs are heated. As a result, an electric potential at a point indicated by reference numeral 5*b* increases. As a result, the resistance value of the heating element reaches the specified resistance value obtained when the surface temperature of the glow plugs 6 to 9 reaches approximately 800° C. Each resistance value of the resistors 16, 17, 19 and 20 is selected so that, when the above mentioned condition is established in the heating element, the output state of the comparator 18 is shifted from L level to H level. Accordingly, when an inverting action from L level to H level is established, the transistor 26 is forcibly turned off. As a result, the contact 11*a* is turned off with the result that the contact 4*a* is also turned off to deenergize the glow plugs 6 to 9. Thus, the heating of the glow plugs is interrupted, thereby preventing the glow plugs being subject to the overheated condition. For this reason, the glow plugs are prevented from being broken.

Once power applied to the glow plugs is interrupted, a small value of the positive voltage rendered by the bias circuit consisting of the resistors 21, 22 and the diode 23 is applied to the non-inverting input terminal of the comparator 18. As a result, the output of the comparator 18 is maintained to be H level. As a result, power feeding to the glow plugs 6 to 9 is maintained to be an interrupted condition.

Next, when it is known by a preheating indicating lamp not shown that the preheating has been established, and accordingly the key switch 3 is then shifted to the ST position, the starter motor not shown is driven and at the same time the transistor 51 is turned on whereby the relay winding 50*c* is energized to close the contact 50*a*. Thus, low voltage is applied from the power source to the glow plugs 6 to 9 through the contact 50*a*, the voltage dropping resistor 15 and resistor 5. The resistance value of the resistor 15 is selected so that the temperatures of the glow plugs 6 to 9 are maintained approximately at 800° C. when the starter motor is actuated.

The aforesaid description has been directed to a normal mode of operation with the control circuit for a plug assembly according to the present invention.

Reference is now made to optional modes of the control circuit of the invention. In the event that the temperatures of the glow plugs 6 to 9 extremely lowers as compared with 800° C. for instance, when the key switch 3 is shifted to the ST position after time passes from the establishment of the preheating, for example, if the temperature lowers to a level below 600° C., the temperature sensing circuit A is for the second time becomes operative to shift the output state thereof to the L level. Therefore, the contact 4*a* is closed to rapidly heat the glow plugs 6 to 9. Then, the contact 4*a* is opened when the temperature of the glow plugs 6 to 9 reaches 800° C. so that the voltage applied to the glow plugs 6 to 9 is lowered due to the fact that the resistor 15 is connected thereto to maintain the temperature thereof at 800° C.

On the other hand, when the engine is placed in high temperature condition, it is not necessary to preheat the engine under the condition that the key switch 3 is at the ON position. Since the water temperature switch 40 of the power interrupting circuit B is closed, the transistor 32 is turned on. As a result, the transistor 26 is forcibly turned off and the relay switch 4 is turned off to interrupt power to the glow plugs 6 to 9.

Next, in the event that the key switch 3 is shifted to the ST position, the transistor 32 is turned off by a bias current fed through the diode 41 independently of the water temperature switch 40 and thus the transistor 26 is turned on. As a result, the relay switch 4 is turned on to rapidly heat the glow plugs 6 to 9 so that the temperature rises. When the temperature reaches 800° C., the output state of the comparator 18 is shifted to H level. As a result, the transistor 26 is turned off whereby the contact 4*a* is opened. Thus, power is fed to the glow plugs 6 to 9 from the contact 50*a* through the resistors 15 and 5. In this manner, when the key switch is shifted from the ON position to the START position, the glow plugs are placed in high temperature condition, approximately 800° C., suitable for the starting of the engine as indicated by 1 in FIG. 2, at which temperature the engine is securely capable of starting.

Reference is made to the case that the engine is placed in low temperature condition and a preheating is established. In this condition with the engine not shown, starts and the key switch 3 is shifted from the ST position to the ON position, the regulator switch 55 is turned off. As a result, a power source voltage is applied to the transistor 53 through the resistor 58 whereby the transistor 53 is turned on and off in accordance with a pulse signal of the oscillator 52. According to this action, the transistor 51 is turned on and off, as a consequence of which the contact 50*a* is turned on and off to intermittently connect the resistor 15 to the power source circuit. Thus, if the period of the pulse signal is set to be a predetermined value, the increase in temperature can be suppressed within a predetermined range. Accordingly, the temperature of glow plugs is maintained constant as shown in FIG. 2 labelled by m due to the fact that the resistor 15 is intermittently connected to the power source circuit. This makes it possible to effect the smooth warming up operation of the engine. Further, even if during this interval the engine is halted due to failure of engine starting, it is possible to raise the temperature of the glow plugs so as to immediately approach the preferable temperature suitable for starting of the engine. Thus, this makes it possible to restart the engine. Here, when the temperature of water for cooling the engine is above a fixed level to turn on the water temperature switch 40, when the gear switch 54 is turned on during vehicle running under the condition that the gear is placed in engaged condition or when the regulator switch 55 is turned on, whereby the transistor 51 is turned off, power fed to the glow plugs 6 to 9 is interrupted so that the temperature lowers.

As described above, in accordance with the present invention, the control circuit is constituted so that after the temperature of the glow plugs reaches a specified temperature suitable for starting, the glow plugs are energized through the resistor at the START position of the key switch to lower the applied voltage, and when the key switch is shifted from the START position to the ON position, the aforesaid resistor is intermittently connected to the glow plugs for heat retention thereof. Accordingly, this makes is possible to maintain the temperature of the glow plugs at a value suitable for starting at the START position and ON position of the key switch, thereby enabling the engine to securely started. Further, with this circuit an undesirable heat produced in the glow plugs can be suppressed to increase the durability. Furthermore, when the glow plugs need not be heated, such as when the engine is already placed in a heated condition, power is not supplied to the glow plugs, thereby making it possible to minimize power consumption. Furthermore, the key switch is of the simplified construction having only three positions, namely, OFF, ON and START positions; the operating procedure of the device according to the present invention is the same as that of gasoline vehicles and thus there is little inharmoneous for those persons familiar with the starting feeling of the gasoline vehicles. Accordingly, the device of the present invention can be effectively mounted on an automobile adapted to be driven by a diesel engine.

What is claimed is:

1. A control circuit for a glow plug assembly serving as an engine preheating means, the control circuit comprising:

(a) a glow plug assembly consisting of a plurality of glow plugs, (b) a key switch having three positions, that is, OFF, ON and START positions, (c) a temperature sensing circuit for starting to supply a power to said glow plug assembly, when said key switch is shifted from the OFF position to the ON position, and interrupting the power thereto, when the temperature of said glow plug assembly reaches a predetermined value, and (d) a heat retaining circuit for interposing a resistor between said glow plug assembly and a power source to lower a voltage applied to said glow plug assembly then that at the time of said preheating for heat retention, when said key switch is shifted from the START position to the ON position, and intermittently connecting said resistor to said glow plug assembly to suppress an increase in temperature of said glow plug assembly, when said key switch is shifted from the START position to the ON position.

2. The control circuit for a glow plug assembly serving as an engine preheating means as defined in claim 1, which further comprises a switching means connected in series with said resistor, said switching means being turned on and off by the output of an oscillator circuit which oscillates with a predetermined period of time.

3. The control circuit for a glow plug assembly serving as an engine preheating means as defined in claim 1, wherein power fed to the glow plug assembly is interrupted by any one of outputs of a water temperature switch which becomes operative when the temperature of water for cooling the engine reaches a predetermined value, a gear switch assembled in a vehicle, and a regulator switch which becomes inoperative when the key switch is shifted from the START position to the ON position.

* * * * *